United States Patent [19]

Kazanovich et al.

[11] 4,142,579

[45] Mar. 6, 1979

[54] AIR RADIATOR COOLING TOWER

[76] Inventors: Boleslav B. Kazanovich, ulitsa Yakornaya, 2, kv. 43, Leningrad; Germes R. Santurian, ulitsa Sayat-Nova, 1, kv. 15, Erevan; Petr A. Fischenko, ulitsa Telmana, 30, kv. 36; Iosif A. Potapenko, ulitsa Vishnevaya, 6, kv. 99, both of Krasnodar; David M. Budnyatsky, 6 Sovetskaya ulitsa, 12, kv. 35, Leningrad; Felix K. Akopdzhanian, ulitsa Tumaniana, 38, kv. 33, Erevan; Tsolak R. Oganesian, mikroraion, 53, kv. 37, Razdan Armyanskoi SSR; Edvard S. Kazarian, ulitsa Teriana, 4, kv. 112, Erevan; Salikh I. Dzhanbaev, ulitsa Saltykova-Schedrina, 10, kv. 1; Alexandr I. Seryapov, ulitsa Staro-Kubinskaya, 119, kv. 57, both of Krasnodar; Albert T. Shakhnazarian, ulitsa Narsesiana, 1, kv. 6; Murad S. Mezhdo, ulitsa Teriana, 4, kv. 19, both of Erevan; Leverie L. Bachilo, ulitsa Antonova-Ovseenko, 13, korpus 1, kv. 10, Leningrad; Anatoly P. Bushmin, ulitsa Kommunarov, 56, kv. 33, Krasnodar; Mikhail B. Gershman, Moskovsky prospekt, 104, kv. 70; Anatoly I. Samokhvalov, Bolshie Polyanki, 21, kv. 89, both of Yaroslavl; Georgy S. Oganesian, ulitsa Metallistov, 13, kv. 42, Erevan, all of U.S.S.R.

[21] Appl. No.: 797,392

[22] Filed: May 16, 1977

Related U.S. Application Data

[63] Continuation of Ser. No. 531,284, Dec. 10, 1974, abandoned.

[51] Int. Cl.[2] ..... F28F 13/10; F28F 19/00; F28F 17/00

[52] U.S. Cl. ..... 165/84; 62/68; 62/123; 165/DIG. 1; 165/134 R

[58] Field of Search ..... 165/DIG. 1, 134, 84; 62/68, 123

[56] References Cited

U.S. PATENT DOCUMENTS

| | | | |
|---|---|---|---|
| 2,960,314 | 11/1960 | Bodine, Jr. | 165/84 X |
| 3,389,974 | 6/1968 | Barattini et al. | 62/123 X |
| 3,577,740 | 5/1971 | Kenworthy et al. | 62/123 X |
| 3,727,679 | 4/1973 | Von Cleve | 165/DIG. 1 |

FOREIGN PATENT DOCUMENTS

| | | | |
|---|---|---|---|
| 669235 | 8/1963 | Canada | 165/DIG. 1 |
| 2249775 | 4/1973 | Fed. Rep. of Germany | 62/68 |

*Primary Examiner*—Albert W. Davis, Jr.
*Attorney, Agent, or Firm*—Fleit & Jacobson

[57] ABSTRACT

An air radiator cooling tower comprising a piping system for the supply and removal of water circulating in cooled tubular elements joined into groups by means of tubular girders, an exhaust tower for the circulation of cooling air, and a device for the excitation of oscillations transmitted through direct contact over the surface of the tubular elements and/or the water being cooled.

The proposed air radiator cooling tower may be employed in power engineering for cooling condensers at steam power stations.

12 Claims, 10 Drawing Figures

AIR RADIATOR COOLING TOWER

This is a continuation of application Ser. No. 531,284 filed Dec. 10, 1974 now abandoned.

The present invention relates to power engineering and, more particularly, to air radiator cooling towers intended for cooling condensers at steam power stations.

Known at present are air radiator cooling towers comprising an exhaust tower, a piping system for the distribution of water in tubular elements being cooled which are joined together by collectors or tubular girders.

An important disadvantage of the known air radiator cooling towers is the danger of water freezing in tubular elements being cooled which are directly exposed to cold air. In order to prevent freezing of tubular elements in winter, the thermal capacity of cooling towers is usually limited by way of switching off part of the tubular elements, as well as by reducing the air flow rate through throttling the air flow as it enters the cooling tower. Although raising the temperature of the cooling water, these measures fail to provide a complete solution to the problem of the freezing of cooling elements. An increase in the temperature of the cooling water impairs the effectiveness of the turbine whose thermal cycle coincides with that of the cooling tower. At the same time it should be noted that in cold climates heat exchange conditions in an air radiator cooling tower may practically account for decreased temperatures of the cooling water, a lower steam pressure in the condenser and greater efficiency of the turbine plant.

It is common knowledge that the amount of power required for mechanical destruction of ice is less by far than that required for melting the ice. Hence, mechanical ice destruction has found application in a great number of devices employed in aircraft industry.

These devices make use of the mechanical pulse method, whereby pulse deformations are produced in the fuselage skin and the layer of ice. Deformation of the fuselage skin is produced by shock-free methods based upon remote contactless action (for example, electromagnetic induction) or scattered contact action.

One of the known methods for the prevention of freezing of elements involves the use of instruments and apparatus based on the use of ultrasonic oscillation.

For a number of reasons, the foregoing methods prove to be impracticable in the case of stationary apparatus. The prevention of freezing of radiator cooling towers is a typical example. Shock-free or scattered contact action upon a tubular girder of a tubular cooling element practically makes it impossible to obtain required values of the oscillation amplitude over the entire cooling surface. In addition, this rules out the possibility of regulating oscillation. Ultrasonic equipment is hard to manufacture and service. The use of a great number of radio components accounts for low reliability of such equipment.

It is an object of the present invention to eliminate the foregoing disadvantages.

The invention aims at providing an air radiator cooling tower which would feature the following:

reliable operation in winter conditions, when subzero temperatures account for supercooling and freezing of water in tubular cooling elements, which results in their rupture;

prevention of freezing by the use of the most effective mechanical methods through contact action of oscillation upon the cooling tower surface being protected;

simple and reliable means for generating pulse oscillation, intended for prolonged operation.

The above objects are attained by providing an air radiator cooling tower comprising a piping system for the supply and removal of water circulating in cooled tubular elements joined into groups by means of tubular girders, and an exhaust tower for the circulation of cooling air, said cooling tower being provided, according to the invention, with an oscillation generating device comprising an actuator and a power source connected thereto to generate oscillations to be transmitted via said actuator and through contact over the surface of tubular elements and/or the water being cooled.

In such an air radiator cooling tower, oscillations of the surface of the tubular elements and the medium being cooled are transmitted to the border (stagnant) zone formed over the inner walls of the tubular cooling elements. Minor mechanical action is sufficient to disturb the process of ice crystallization over the walls of the tubular elements. Optimum values of the amplitude and the repetition frequency of oscillations account for complete prevention of freezing of tubular elements of cooling towers.

Oscillations over the surface of tubular elements may be excited with the aid of a device whose actuator comprises a rod waveguide, one end thereof being connected to a tubular girder of a tubular element being cooled, and a solenoid with a ferromagnetic core performing the function of a striking element, the coil of said solenoid being secured at the other end of the waveguide and connected to a pulse generator.

It is expedient that said rod waveguide be bent and its end with the solenoid coil be arranged vertically and coaxially with the striking element and inserted inside said solenoid.

In order to regulate the distance between the waveguide end and the striking element of the solenoid, it is desirable that the end of the waveguide secured whereto is the solenoid coil and the coil frame be threaded.

It is expedient that the lower end of the waveguide be made of a non-magnetic material to prevent "adhesion" of the striking element to the waveguide as a result of residual magnetism.

Excitation of oscillations may be effected with the aid of a device based upon the use of a phenomenon known as electrolhydraulic pressure surge in fluids. In accordance with the invention, the actuator of this device comprises a radiator with a housing made in the form of a paraboloid with a flat wall facing the tubular girder, said housing being filled with a liquid and containing electrodes connected to a power source, and a waveguide, the flat wall of the radiator housing being made in the form of a piston provided with a packing, the function of the waveguide being performed by a piston rod which rigidly secures the piston to the tubular girder of the tubular element being cooled.

Stable operation of the radiator is provided for by a tank mounted on the radiator housing; said tank is intended for automatic feeding of the radiator and communicates with the latter's cavity.

In the lid of the tank there is an opening for removal of gasses from the radiator housing.

The liquid filling the radiator housing is a saturated aqueous solution of sodium chloride, which provides for low freezing temperature of the water and increased electric conductivity thereof.

Oscillations on the surface of tubular elements may be excited with the aid of a device based on the ability of a moving body to develop a substantial force of inertia which is imparted to the housing and makes it vibrate. In this device the actuator comprises a waveguide whose one end is secured to a tubular girder of a tubular element being cooled, whereas its other end is secured to a casing having an annular inner race with a ball movable by compressed air supplied through at least one nozzle arranged at the inner surface of the casing, the waveguide being arranged in the same plane with the nozzle.

In case there are several nozzles in the casing, the nozzles may be arranged equidistantly to form a portion of a circumference.

In order to enhance the exciting force of the radiator, it is expedient that the ball be made hollow.

Apart from the foregoing devices for transmission of oscillations over metal structures of tubular elements, the present invention contemplates a device to excite oscillations in a medium being cooled. In this device the actuator comprises electrodes disposed inside a distribution duct and connected to a pulse generator by means of current conductors passed through and insulated from the walls of the distribution duct.

In order to lessen the action of pulse oscillations upon the circulation pump wheel, the electrodes to produce electrohydraulic effect are mounted on the duct for removal of water downstream of the cooling tower.

In order to maintain the constancy in time of discharge energy, the electrodes are arranged parallel to one another.

The objects and advantages of the present invention will become more apparent from the following detailed description of specific embodiments thereof when read in conjunction with the accompanying drawings, wherein.

Figure 1:
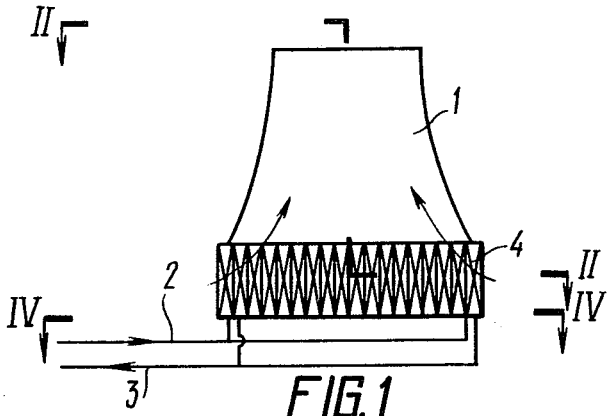
FIG. 1 is a schematic side view of an air radiator cooling tower.
Figure 2:
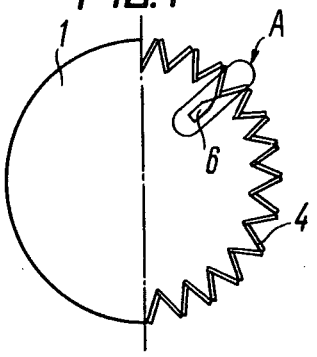
FIG. 2 is a section along line II—II of FIG. 1 with unit A.
Figure 3:
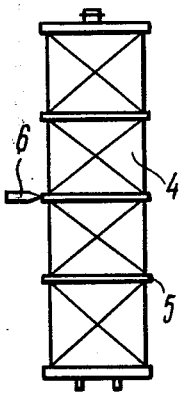
FIG. 3 is a side view of the unit A.

As is seen from FIGS. 1 and 2, the proposed air radiator cooling tower comprises an exhaust tower 1, piping systems 2 and 3, the first being intended for the supply and the second, for the removal, of water circulating in tubular elements 4 being cooled, said elements being joined into groups by tubular girders 5 (FIG. 3). Devices for excitation of oscillations (indicated by the reference numeral 6) are secured to the tubular girders 5 of the tubular elements 4 (unit A of FIGS. 2 and 3) or are disposed inside the distribution duct 3 (unit B of FIG. 4).

Figure 5:
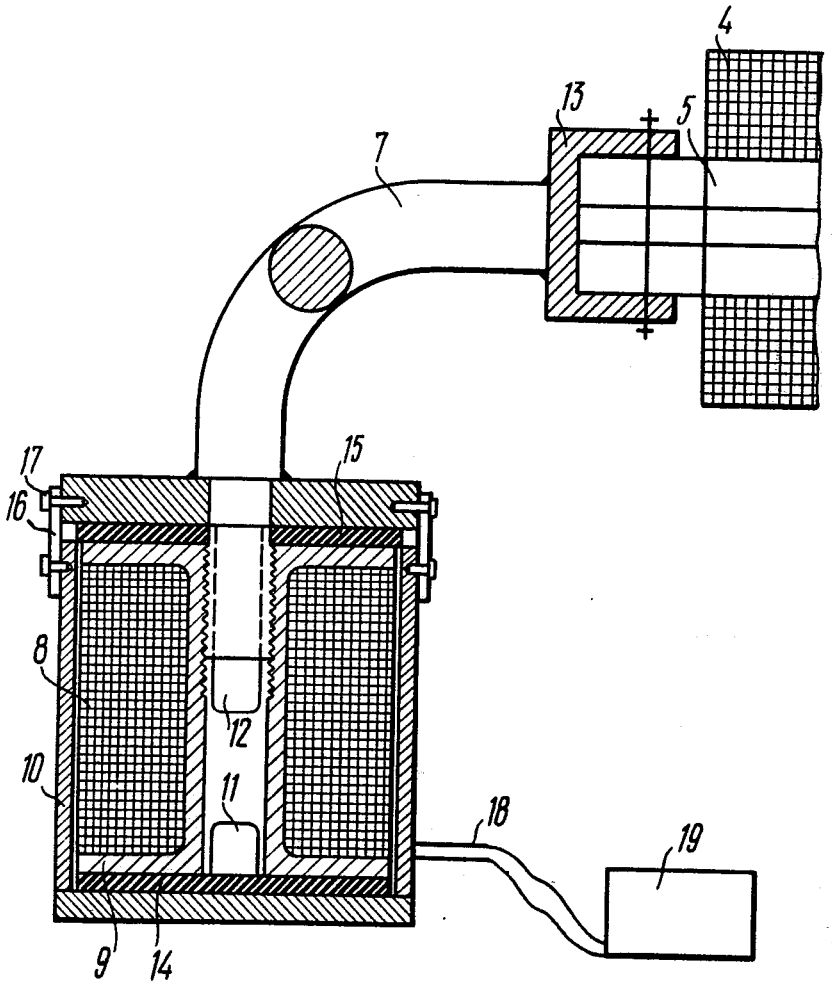
FIG. 5 shows an alternative version of a device for excitation of oscillations whose actuator comprises, in accordance with the invention, a waveguide and a solenoid with a striking element, the coil of said solenoid being connected to a pulse generator.

An embodiment of a device for excitation of oscillations transmitted over the surface of the tubular elements 4 is shown in FIG. 5. It comprises a rod waveguide 7 and a solenoid including a coil 8 wound around a frame 9 disposed inside a metal housing 10. Disposed inside the coil 8 is a movable ferromagnetic core to perform the function of a striking element 11. One end 12 of the waveguide 7 is inserted into the coil 8 and is made from a non-magnetic material. The other end of the waveguide 7 is connected with the aid of a pick-up 13 to the tubular girders 5 of the tubular cooling elements 4 of the cooling tower. Blows delivered by the element 11 against the casing 10 are absorbed by rubber packings 14 and 15. The casing 10 and the waveguide 7 are joined together with the aid of strips 16 and pins 17. The solenoid coil 8 is connected by current conductors 18 to a pulse generator 19.

Figure 6:
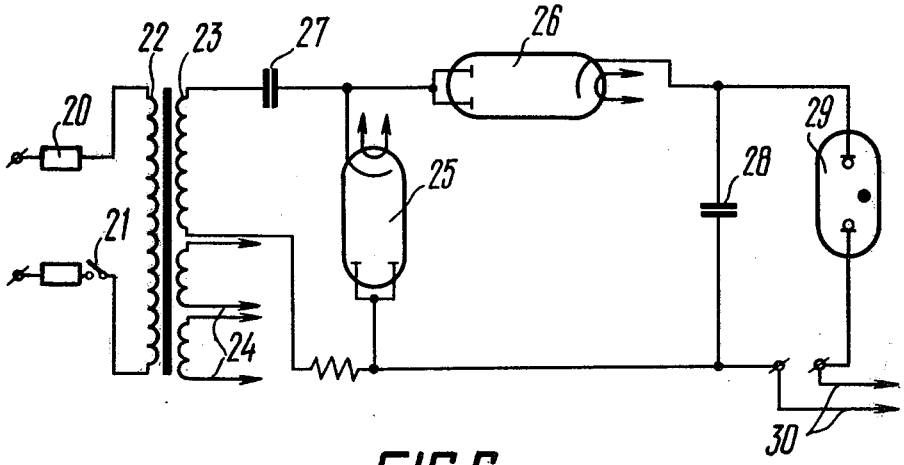
FIG. 6 is a key diagram of an electric pulse generator.

The key diagram of the generator 19 is shown in FIG. 6. From the mains, alternating voltage is applied via fuses 20 and a closing switch 21 to a primary winding 22 of a power transformer. Apart from the primary winding 22, said transformer has a high-voltage winding 23 and two filament windings 24 for feeding kenotrons 25 and 26. From the high-voltage winding 23 voltage is applied to a fullwave rectifier acting as a voltage doubler, said rectifier being built around said two kenotrons 25 and 26 and two capacitors 27 and 28; a discharger 29 is connected to the latter. As voltage across the capacitor 28 reaches the triggering threshold of the discharger 29, this latter is actuated and closes a solenoid circuit 30 shown in FIG. 5. At this moment, a current of up to 1,000 a flows through the solenoid, producing a powerful electromagnetic field pulse. This pulse generator makes it possible to obtain an electric capacity of a pulse of ~2 mw with a pulse duration of about 15 microseconds.

In this case the proposed air radiator cooling tower operates as follows.

The medium being cooled (water) is supplied through the distribution duct 2 to the tubes of the cooling elements 4 of the air radiator cooling tower where it is cooled by outside air supplied through the exhaust tower 1 of the cooling tower (the direction of the air flow is shown by the arrows in FIG. 1).

To prevent the freezing of the tubular cooling elements 4 in winter, use is made of the devices for excitation of oscillations shown in FIGS. 5 and 6.

A current pulse is applied from the pulse generator to the coil 8. Under the action of a pulsed magnetic field the striking element 11 is vigorously drawn into the coil 8 and strikes a sharp blow at the waveguide 7. The waveguide 7 is bent, its free end being arranged vertically and coaxially with the striking element 11 and is inserted into the solenoid. The lower end of the waveguide 7 is arranged close to the middle of the coil 8, as at this level the striking element develops a maximum speed and, consequently, a maximum striking force.

Mechanical oscillations are transmitted through the waveguide 7 and the pick-up 13 to the tubular girders 5 and then to the tubular elements 4, causing disturbances in the border layer where microcrystals of ice are formed.

The amplitude of the oscillations is regulated by gradually changing the distance between the striking element 11 and the lower end of the waveguide 7. The frame 9 of the coil 8 and the lower end 12 of the waveguide 7 are threaded, which makes it possible to obtain a required distance between the striking element 11 and the waveguide 7.

This permits one to smoothly change the oscillation amplitude within a wide range, by way of changing the distance between the lower end 12 of the waveguide 7 and the striking element 11.

The necessity of changing the amplitude is due to the selection of optimum operating conditions for the device at different temperatures of the cooling elements and is also dictated by the permissible strength characteristics of the equipment.

To provide, in the course of operation, for a constant distance between the lower end 12 of the waveguide 7 and the striking element 11 (before it strikes), the lower end 12 of the waveguide 7 is made of a non-magnetic material. This aims at preventing the striking element 11 from remaining in a suspended position after it strikes, which is due to residual magnetism. This is of particular importance at a high rate of striking (upwards of 5 blows per second).

It is difficult to smoothly change the oscillation amplitude by employing electric means, as this may entail abrupt variations in the capacitance of the discharge capacitor 28; on the other hand, a selection of capacitors having a lower capacitance presupposes increased dimensions and reduced reliability of the device.

Figure 7:
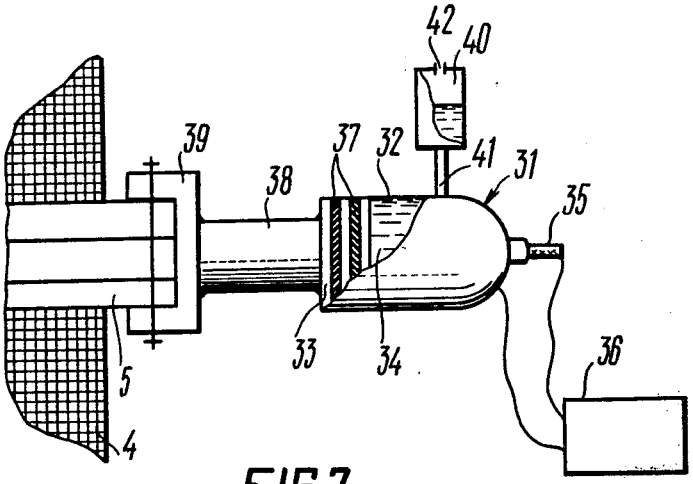
FIG. 7 shows an alternative embodiment of a device for excitation of oscillations whose actuator comprises, in accordance with the invention, a liquid-filled radiator with electrodes disposed in its housing, said electrodes being connected to a power source.

Another embodiment of the proposed device for excitation of oscillations to be transmitted to the tubular elements 4 (FIG. 7) comprises a radiator 31 whose housing 32 is made in the form of a paraboloid with a flat wall 33 and is filled with a fluid 34. Disposed in the housing 32 are tungsten electrodes 35 connected to a pulse generator 36. The flat wall 33 of the housing 32 is made in the form of a piston provided with packings in the form of rubber rings 37. The piston rod 38 is a waveguide which rigidly secures the rod to the tubular girder 5 of the tubular element 4 being cooled with the aid of a pick-up 39. In addition, the device includes a tank 40 for automatic feeding of the radiator 31, said tank communicating with the latter via a pipe 41. In the upper lid of the tank 40 there is an opening 42.

The foregoing device operates as follows.

High-voltage pulses of a small duration are applied from the pulse generator 36 to the electrodes 35. This produces powerful discharges in the fluid 34, which sharply raises the pressure inside the housing 32 of the radiator 31, the increased pressure acting upon the piston (the flat wall) 33. The maximum radiation amplitude is concentrated in the center of said wall, which is due to the fact that the opposite wall of the radiator 31 is made in the form of a paraboloid. The radiation antinode is concentrated on said piston 33 and is transmitted by the rod waveguide 38 via the pick-up 39 to the tubular girder 5 of the tubular cooling element 4, whereto it is rigidly secured. The oscillations are further transmitted to the tubes of the cooling elements 4 and prevent their freezing at subzero temperatures.

The fact that the piston is movable inside the housing 32 of the radiator 31 makes it possible to substantially increase the amplitude of oscillations so that it reaches tens and even hundreds of microns. The fact that the rod waveguide 38 is secured at the center of the piston 33 makes it possible to transmit oscillations with a maximum amplitude. The length of the rod waveguide 38 is selected between 20 and 40 cm and is determined by such considerations as the convenience of assembly, arrangement, etc. Gasses resulting from electric discharges in the radiator 31 are released through the pipe 41 communicating with the tank 40 having the opening 42 in its lid. The tank 40 is intended to provide excess fluid pressure.

The propulsive mass in the proposed device is the fluid 34 which is a saturated aqueous solution of sodium chloride. This ensures low freezing temperature and increased electric conductivity of the water.

Pulse pressures in the housing 32 of the radiator 31 are in the main applied to the piston 33 rigidly secured thereto. This raises the efficiency of the radiator, as excluded from the total amount of energy required to produce a water hammer is the energy consumed to overcome the intermolecular forces in the metal. This augments the amplitude of instantaneous oscillations transmitted to the tubular elements without destroying the radiator.

Figure 8:
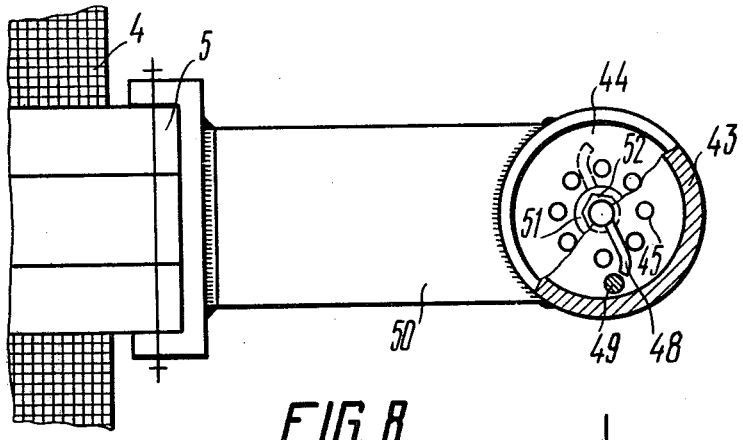
FIGS. 8 and 9 show an alternative embodiment of a device for excitation of oscillations in two projections, the actuator of said device comprising, in accordance with the invention, a waveguide and a casing having an annular inner race with a ball which is set in motion by compressed air supplied through a nozzle.
Figure 9:
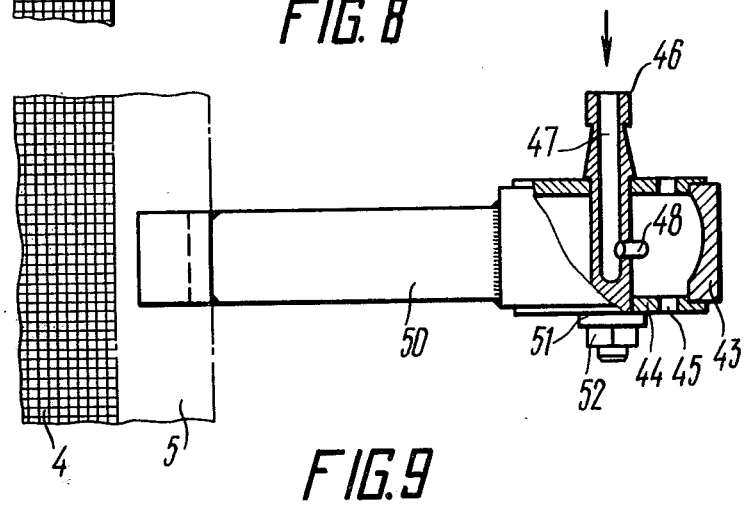

Oscillations to be transmitted to tubular elements may also be effectively excited with the aid of a device shown in FIGS. 8 and 9.

This device comprises a casing 43 with an annular inner race closed on both sides by flanges 44 having openings 45, said flanges being joined together by a pipe connection 46 (FIG. 9) having a channel 47 for the supply of compressed air (the direction of the air supply is shown by the arrow). Inserted radially into the channel 47 is a bent branch pipe provided with a nozzle 48 through which compressed air is supplied to a ball 49 (FIG. 8), setting the latter in motion along the annular race of the casing 43. This produces elastic vibrations which are transmitted from the casing 43 to the tubular girder 5 of the tubular element 4 being cooled with the aid of a waveguide 50. The pipe connection 46 is secured in place with the aid of a washer 51 and a nut 52.

The above device for excitation of oscillations operates as follows.

Air, which is compressed to reach a pressure of 2 to 5 atm, is supplied through the channel 47 and via the branch pipe provided with the nozzle 48 into the pipe connection 46 and sets in motion the ball 49 which moves at a great speed along the face of the casing 43. In a few seconds the ball 49 develops a substantial speed which, however, is less than that of the air flow from the nozzle 48. The branch pipe with the nozzle 48 is bent so as to ensure a maximum pressure upon the surface of the ball 49, the lower edge of the branch pipe 48 being 2 to 3 mm above the upper portion of the ball 49 so as not to block the latter's movement. The moving ball develops a substantial centrifugal force of inertia which acts upon the casing 43 and makes it vibrate. Elastic vibrations produced in the casing 43 are transmitted with the aid of the waveguide 50 to the tubular girder 5 and further to the tubular cooling elements 4, causing disturbances in the border layer at the inner surface of the tubular elements, i.e. the zone of ice crystallization. In turn, disturbances in the zones of ice crystallization make it possible to prevent the freezing of the inner surface of the tubular elements.

To raise the effectiveness of the radiator by way of increasing the air flow rate, it is expedient that two or several nozzles be provided (shown by the dotted line in FIG. 8), said nozzles being spaced equidistantly to form a portion of a circumference. To raise the rotation speed of the ball 49, the latter is made hollow.

The frequency and amplitude of oscillations are determined by the geometrical dimensions of the casing 43 and the ball 49 and by the pressure and flow rate of compressed air. The frequency range of the device may be selected between several hundreds of cycles and tens of kilocycles. The oscillation amplitude of the radiator depends upon the mass of a metal structure connected thereto.

Figure 4:
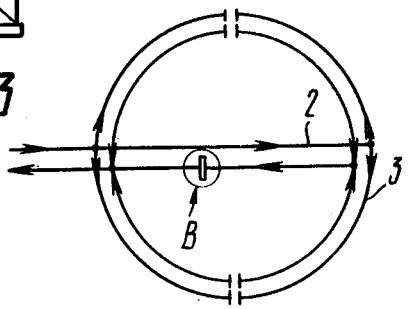
FIG. 4 is a section along line IV—IV of FIG. 1 with unit B.
Figure 10:
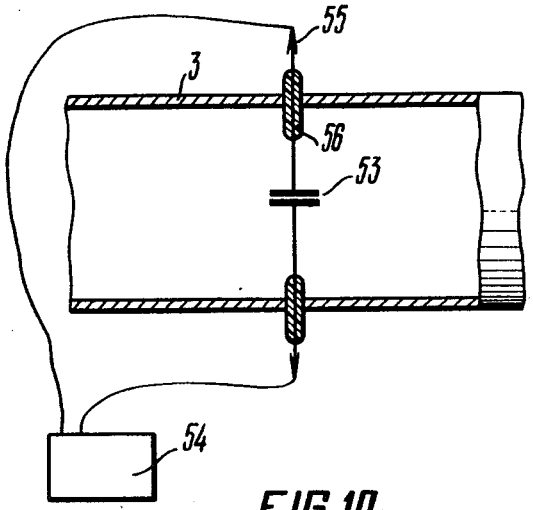
FIG. 10 shows an alternative embodiment of a device for excitation of oscillations whose actuator comprises, in accordance with the invention, electrodes disposed inside a distribution duct and connected to a pulse generator.

Apart from the foregoing methods for transmission of oscillation through metal structures, the freezing of air radiator cooling towers may also be prevented by producing electroyhydraulic pressure surges in the medium being cooled as is shown in FIGS. 4 and 10.

In this case disposed inside one of the pipelines 2 and 3, for example, the pipeline 3, are electrodes 53 connected to a pulse generator 54 by current conductors 55 which pass through partition insulators 56.

At subzero temperatures the pulse generator 54 shown in FIG. 6 is brought into action. High-voltage electric pulses of small duration are supplied from the pulse generator 54 via the current conductors 55 to the electrodes 53 disposed inside the pipeline 3 of the cooling tower. This produces a powerful electrohydraulic discharge in the water, which is accompanied by shock waves. This phenomenon is known in technology as the Yutkin effect. Propagating at a great speed (about 1,500 m/sec), the shock waves rush into the tubular element of the cooling tower and cause disturbances in the zone of ice crystallization adjoining the inner surface of the tubes. This prevents the freezing of the tubular elements of the air radiator cooling tower.

It is expedient that the electrodes be installed in the discharge pipe downstream of the cooling tower, as in this case the adverse effect of electrohydraulic pressure surges upon the pump blades is substantially mitigated.

In order to maintain the constancy in time of the discharge energy, the electrodes are made of tungsten and arranged parallel to one another. This ensures simultaneous operation of the electrodes, as each time discharges will cover their entire length, following the line of least resistance. As a result, the service life of the electrodes is substantially prolonged so that they may last at least through the whole winter.

Optimum operating conditions for the proposed freezing prevention devices are selected by changing the discharge capacity and discharge voltage of the capacitors the electric pulse generator.

What is claimed is:

1. An air radiator cooling tower comprising a piping system comprising tubular elements, means for circulating water in said tubular elements for cooling said tubular elements, tubular girder means for joining said elements into groups, an exhaust tower for circulation of cooling air; means for preventing freezing of said tubular elements by preventing the crystallization of ice on the walls of the tubular elements comprising a rod waveguide having one end secured to said tubular girder means of the tubular elements being cooled, means for producing oscillations operatively connected to the other end of said rod waveguide for excitation of oscillations to be transmitted via said rod waveguide by way of contact over the surface of said tubular elements and/or the medium being cooled.

2. An air radiator cooling tower as claimed in claim 1, wherein said means for producing oscillations comprise a casing having an annular inner race with a ball set in motion by compressed air supplied through at least one nozzle disposed at the inner side of said casing, said waveguide being arranged in the same plane with said nozzle.

3. An air radiator cooling tower as claimed in claim 2, further comprising a plurality of said nozzles in said casing, the nozzles being arranged equidistantly to form a portion of a circumference.

4. An air radiator cooling tower as claimed in claim 2, wherein said ball is hollow.

5. An air radiator cooling tower as claimed in claim 1, wherein said actuator of the device for excitation of oscillations comprises a rod waveguide whose one end is secured to said tubular girder of the tubular element being cooled, and a solenoid with a movable ferromagnetic core performing the function of a striking element, the coil of said solenoid being secured at the other end of said waveguide and connected to a pulse generator.

6. An air radiator cooling tower as claimed in claim 5, wherein said rod waveguide is bent and its end connected to said solenoid coil is arranged vertically and coaxially with said striking element and is inserted into said solenoid.

7. An air radiator cooling tower as claimed in claim 6, wherein said end of the waveguide connected to said solenoid coil and the frame of the coil are threaded in order to regulate the distance between said end of the waveguide and said striking element of the solenoid.

8. An air radiator cooling tower as claimed in claim 7, wherein said end of the waveguide connected to said solenoid coil is made of a non-magnetic material.

9. An air radiator cooling tower as claimed in claim 1, wherein said actuator of the device for excitation of oscillations comprises a radiator whose housing is made in the form of a paraboloid with a flat wall facing said tubular girder, said housing being filled with a fluid and having electrodes disposed therein, said electrodes being connected to a pulse generator, and a waveguide, said flat wall of the radiator housing being made in the form of a piston with a packing, whereas said waveguide is the rod of said piston which rigidly secures the latter to said tubular girder of the tubular element being cooled.

10. An air radiator cooling tower as claimed in claim 9, wherein there is mounted upon said radiator housing a tank for automatic feeding of said radiator, said tank communicating with the latter's cavity.

11. An air radiator cooling tower as claimed in claim 10, wherein in the lid of said tank there is an opening for the removal of gasses from said radiator housing.

12. An air radiator cooling tower as claimed in claim 11, wherein said fluid filling the radiator housing is a saturated aqueous solution of sodium chloride.

* * * * *